US010669744B2

(12) United States Patent
Arnold et al.

(10) Patent No.: US 10,669,744 B2
(45) Date of Patent: Jun. 2, 2020

(54) MECHANICAL OVERRIDE OF AN ELECTRONIC LOCK

(71) Applicant: Sargent & Greenleaf, Inc., Nicholasville, KY (US)

(72) Inventors: David Lee Arnold, Danville, KY (US); Michael Robert Clark, Lexington, KY (US); Tommy O. Lowe, Lexington, KY (US); Joseph Edward Miller, Versailles, KY (US)

(73) Assignee: Sargent & Greenleaf, Inc., Nicholasville, KY (US)

( * ) Notice: Subject to any disclaimer, the term of this patent is extended or adjusted under 35 U.S.C. 154(b) by 86 days.

(21) Appl. No.: 15/548,347

(22) PCT Filed: Feb. 2, 2016

(86) PCT No.: PCT/US2016/016123
§ 371 (c)(1),
(2) Date: Aug. 2, 2017

(87) PCT Pub. No.: WO2016/126675
PCT Pub. Date: Aug. 11, 2016

(65) Prior Publication Data

US 2018/0016815 A1 Jan. 18, 2018

Related U.S. Application Data

(60) Provisional application No. 62/110,789, filed on Feb. 2, 2015.

(51) Int. Cl.

| | |
|---|---|
| ***E05B 47/00*** | (2006.01) |
| ***E05B 47/06*** | (2006.01) |
| *E05B 65/00* | (2006.01) |

(52) U.S. Cl.
CPC ..... *E05B 47/0012* (2013.01); *E05B 47/06* (2013.01); *E05B 47/0603* (2013.01);
(Continued)

(58) Field of Classification Search
CPC .. E05B 47/00; E05B 47/0001; E05B 47/0012; E05B 47/06; E05B 47/0603;
(Continued)

(56) References Cited

U.S. PATENT DOCUMENTS 3,991,596 A * 11/1976 Gartner ..... E05B 37/08 70/303 A
4,375,159 A * 3/1983 Bechtiger ..... E05B 21/066 70/326
(Continued)

FOREIGN PATENT DOCUMENTS

DE 3941426 A1 6/1991
EP 2495379 B1 5/2016
(Continued)

OTHER PUBLICATIONS

EP Search Report dated Nov. 14, 2018 issued in corresponding EP Application No. 16747093.9.

*Primary Examiner* — Christopher J Boswell
(74) *Attorney, Agent, or Firm* — Baker & McKenzie LLP

(57) ABSTRACT

An electromechanical lock according to the present invention includes a lock extension and a blocking module having an interior region. A pivot bolt is mounted in the interior region for rotation about a rotation axis between a nominal position and an unsecured position. First and second blockers are also disposed in the interior for movement between their respective nominal positions and an unblocking position. The lock further includes an override disposed in the interior region for movement between a nominal position and an override position. The lock is in a secured condition when the first and second blockers and the override are in their respective nominal positions and an unsecured condition when the second blocker is in its unblocking position.

19 Claims, 6 Drawing Sheets

(52) U.S. Cl.
CPC ... *E05B 65/0075* (2013.01); *E05B 2047/0017* (2013.01); *E05B 2047/0024* (2013.01); *E05B 2047/0084* (2013.01)

(58) Field of Classification Search
CPC ..... E05B 2047/0024; E05B 2047/0084; E05B 2047/0086; E05B 49/00; E05B 49/002
See application file for complete search history.

(56) References Cited

U.S. PATENT DOCUMENTS

| | | | | |
|---|---|---|---|---|
| 7,770,944 | B2 * | 8/2010 | Yuan | E05B 47/0012 292/195 |
| 8,261,586 | B2 * | 9/2012 | Gartner | E05B 47/0002 292/201 |
| 9,657,500 | B2 * | 5/2017 | Min | E05B 47/00 |
| 10,145,156 | B2 * | 12/2018 | Aker | E05B 47/0603 |
| 2006/0032418 | A1 | 2/2006 | Smith | |
| 2008/0303290 | A1 | 12/2008 | Yuan | |
| 2008/0314100 | A1 * | 12/2008 | Min | E05B 47/0012 70/278.1 |
| 2010/0288000 | A1 * | 11/2010 | Reichl | E05B 15/0086 70/277 |
| 2016/0244995 | A1 * | 8/2016 | Gartner | E05B 49/00 |
| 2018/0051486 | A1 * | 2/2018 | Yuan | E05B 17/2034 |
| 2018/0202192 | A1 * | 7/2018 | Du | E05B 29/00 |

FOREIGN PATENT DOCUMENTS

| | | | |
|---|---|---|---|
| GB | 2279401 | A1 | 1/1995 |
| JP | H10266653 | A | 10/1998 |

* cited by examiner

MECHANICAL OVERRIDE OF AN ELECTRONIC LOCK

The present invention relates to electromechanical locks and blocking mechanisms therefore. More particularly, it relates to manual overrides of the blocking mechanism.

BACKGROUND OF THE INVENTION

Federal Specification FF-L-2890B governs lock extensions and categorizes them as follows: pedestrian door preassembled locks (PDPL), pedestrian door lock assembly panic (PDLAP), and auxiliary deadbolts (ADB) for use with changeable combination locks and strikes. For each of these categories of extension, the specification defines types with key access control and types with keyless access control. Additionally, these extensions should be right and left hand interchangeable.

This invention was pursued to meet both the keyed and electronic access capabilities required per FF-26890B and be suitable for either right or left hand mounting. A single, reversible device with both access capabilities helps to optimize system design by minimizing components and packaging. The present invention can also be used in other high security lock applications where redundant access capabilities are desired.

SUMMARY OF THE INVENTION

An electromechanical lock according to the present invention includes a lock extension and a blocking module having an interior region. A pivot bolt is mounted in the interior region for rotation about a rotation axis between a nominal position and an unsecured position. First and second blockers are also disposed in the interior for movement between their respective nominal positions and an unblocking position. The lock further includes an override disposed in the interior region for movement between a nominal position and an override position. The lock is in a secured condition when the first and second blockers and the override are in their respective nominal positions and an unsecured condition when the second blocker is in its unblocking position.

DETAILED DESCRIPTION OF THE DRAWINGS

Figure 1:
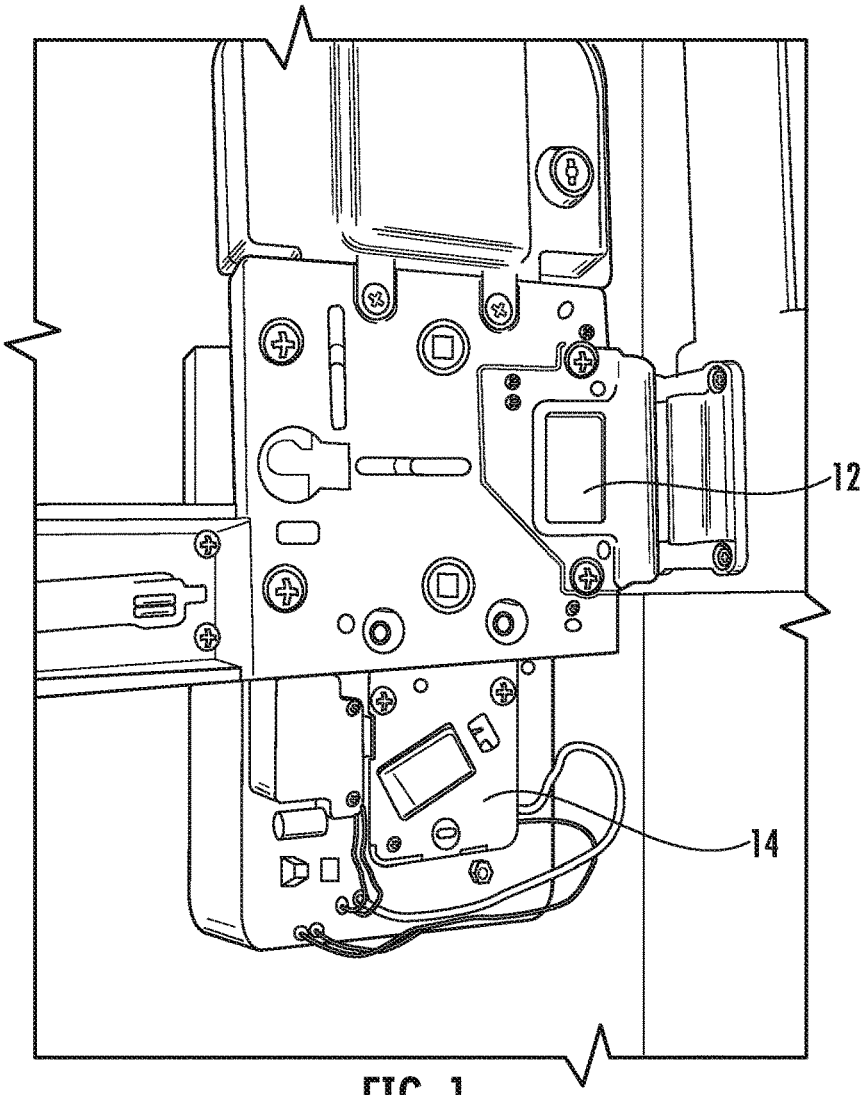
FIG. 1 illustrates an exemplary blocking module in position to block a lock extension.
Figure 2:
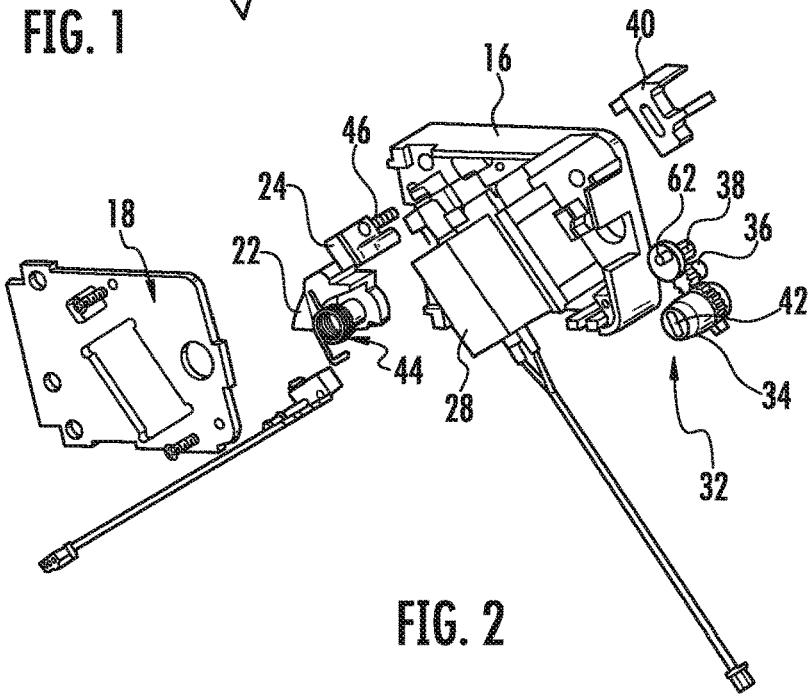
FIG. 2 is an exploded view of the blocking module of FIG. 1.

As illustrated in FIG. 1, a blocking module 10 is disposed adjacent a lock extension 12. The blocking module 10 includes a pivot bolt 14 that extends into the housing of the lock extension 12 to maintain the lock in a secured condition. The blocking module 10 and lock extension 12 would typically form an electromechanical safe lock and be housed in a metal (typically zinc alloy), rectangular case and enclosed by a stainless steel plate cover screwed to the case (not shown).

As illustrated in FIGS. 2-5, the blocking module 10 can include a housing 16 and cover 18 defining an interior region. The pivot bolt 14, a sliding blocker 24 and spin blocker 26 driven by motor 28 are mounted in the interior region. In addition, a manual override 32, including a drive gear 34, an idler gear 36, and drive pin gear 38, is positioned to drive a plunger 40. The drive gear includes a key-receiving slot 42 disposed along its rotational axis.

The pivot bolt 14 includes an integral spindle 22 that nests inside holes in the case and cover and is constrained to rotation about the spindle axis. The sliding blocker 24 is disposed in a channel 25 in the floor of the housing 16 and is constrained to move linearly in the channel 25. In preferred embodiments, the pivot bolt 14 is biased to a lock secured condition by a torsion spring 44. The sliding blocker 24 is biased by a compression spring 46 to block the pivot bolt 14 from pivoting to a lock unsecured condition. The spin blocker 26 is biased by a torsion spring 48 to prevent the sliding blocker 24 from releasing the pivot bolt 14.

The spin blocker 26 has a circular wedge 52 extending from its center as well as a lever 54 that extends in an opposing direction. The spin blocker's central, cylindrical body is pressed onto an electric motor shaft and the assembly is then placed in a recess in the housing 16 with the wedge 52 positioned toward the sliding blocker 24. The torsion spring 48 is applied to the spin blocker 26 to resist counter clockwise rotation as viewed from the output shaft side of the motor 28.

The spin blocker 26 lever extends away from the pivot bolt 14 and makes contact with a plunger 40. The plunger 40 has feet 56 that slide within grooves 58 in the housing 16. The plunger 40 includes a slot 60 in which the drive pin 62 of the drive pin gear 38 is inserted. The pin 62 is offset from the rotational axis of the drive pin gear 38 and travels an orbital path about this axis when the drive pin gear 38 rotates. This orbital motion of the pin 62 interacting with the slot 60 induces translation of the plunger 40 within the housing 16.

Figure 3A:
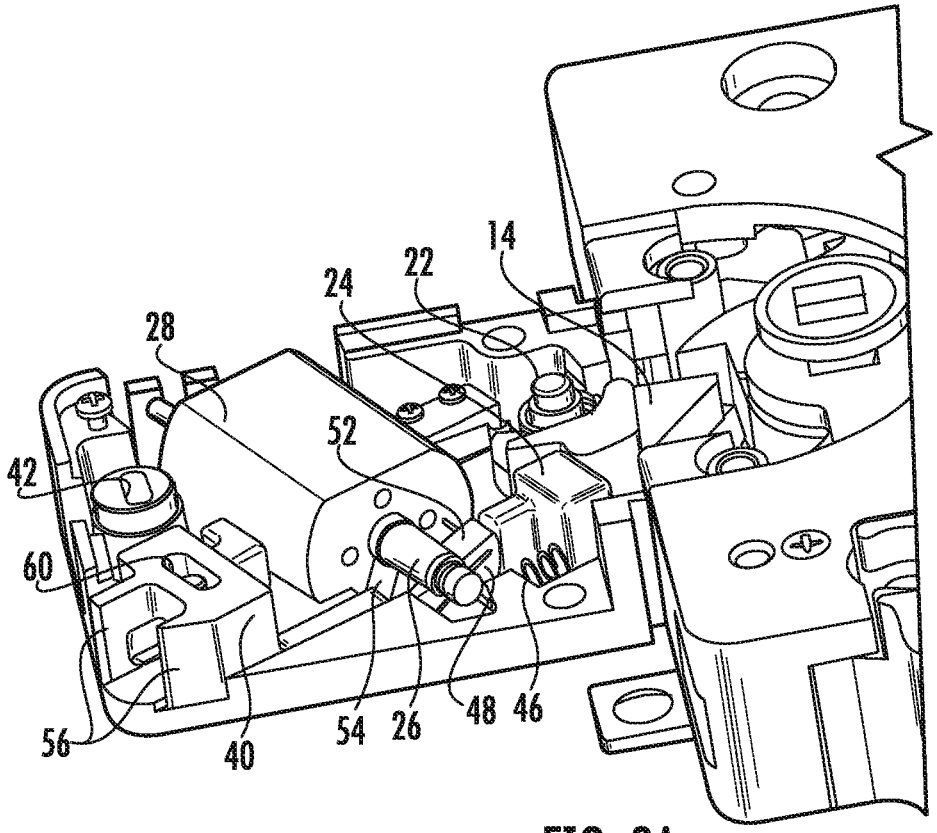
FIGS. 3A-3C illustrate the blocking module and extension, partially cut away, in a nominal, or blocking, condition.
Figure 3B:
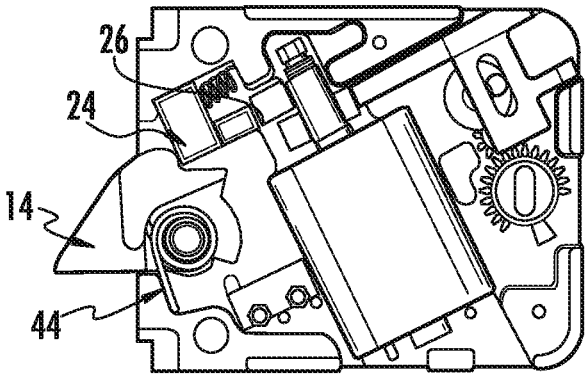
Figure 3C:
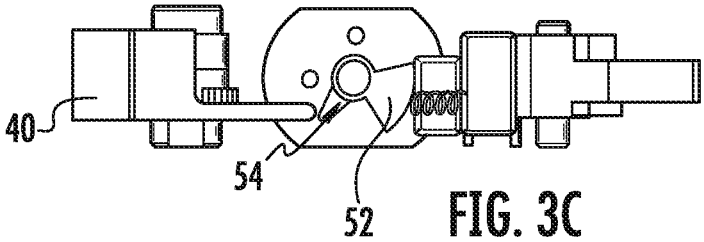
Figure 4A:
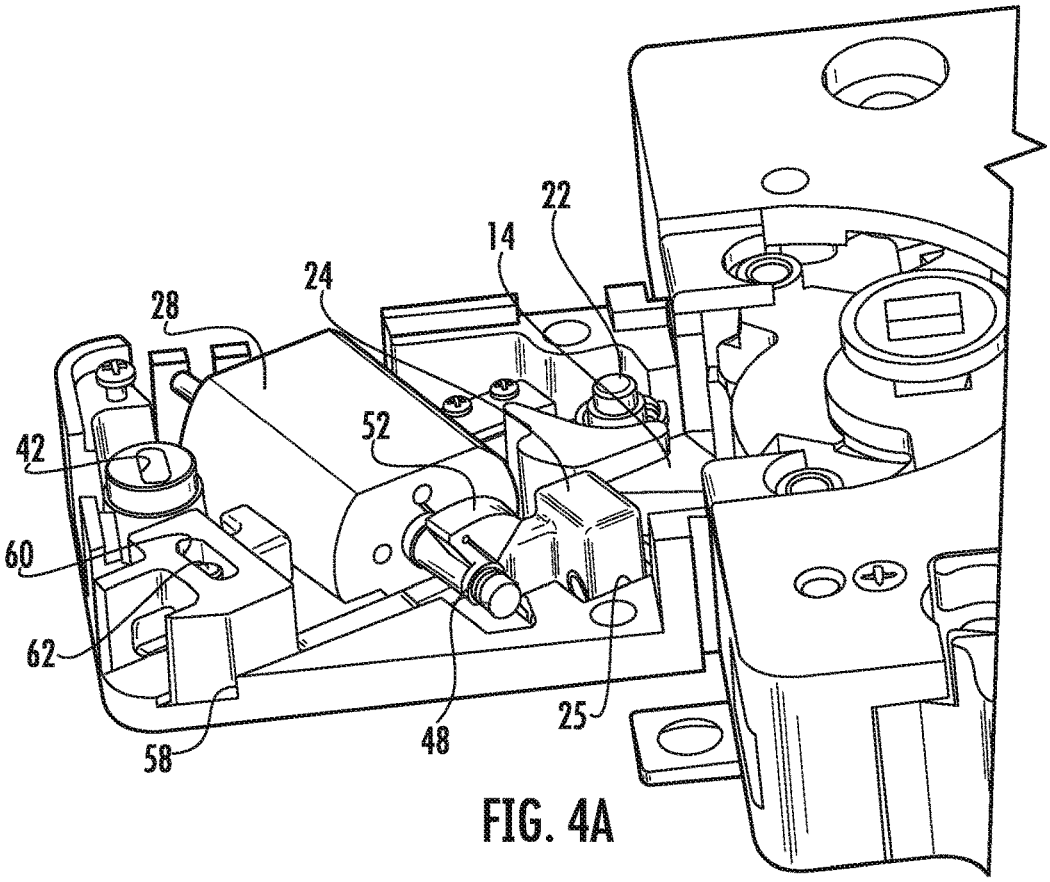
FIGS. 4A-4C illustrate the blocking module and extension, partially cut away, in an unblocking condition.
Figure 4B:
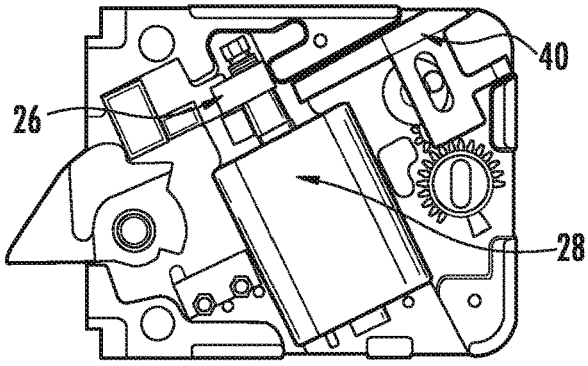
Figure 4C:
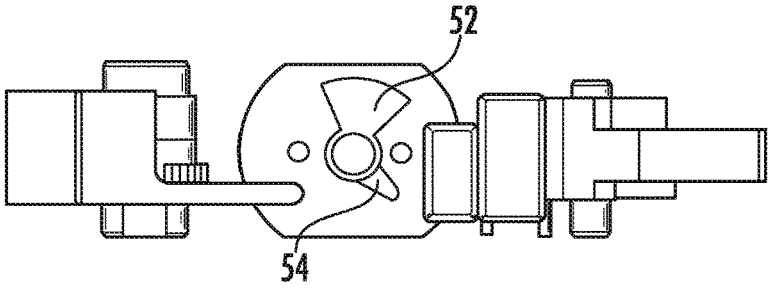

When secured, as illustrated in FIG. 3, the pivot bolt 14 is extended, the sliding blocker 24 contacts the pivot bolt 14, and the spin blocker wedge 52 is in the path of the sliding blocker 24 to prevent it from sliding. Force on the pivot bolt 14 closes any gaps between the pivot bolt 14, sliding blocker 24, spin blocker 26 and pushes the spin blocker wedge 52 against the floor of the housing 16, thus resisting further movement of the pivot bolt 14.

To allow the pivot bolt 14 to retract into the blocking module 10, the spin blocker 26 must be rotated such that the spin blocker wedge 52 is moved out of the path of the sliding blocker 24 as illustrated in FIGS. 4-7. This movement can be achieved by two methods. In keyless access control, an electrical current is supplied to the motor 28, causing the spin blocker 26 to rotate and clear the path for the sliding blocker 24. Rotation of the spin blocker 26 is limited to ~90° by lock structure. When motor current is stopped and the pivot bolt 14 returns to its extended position, the sliding blocker 24 and spin blocker 26 are returned to secured position by springs 46 and 48, respectively.

Figure 5:
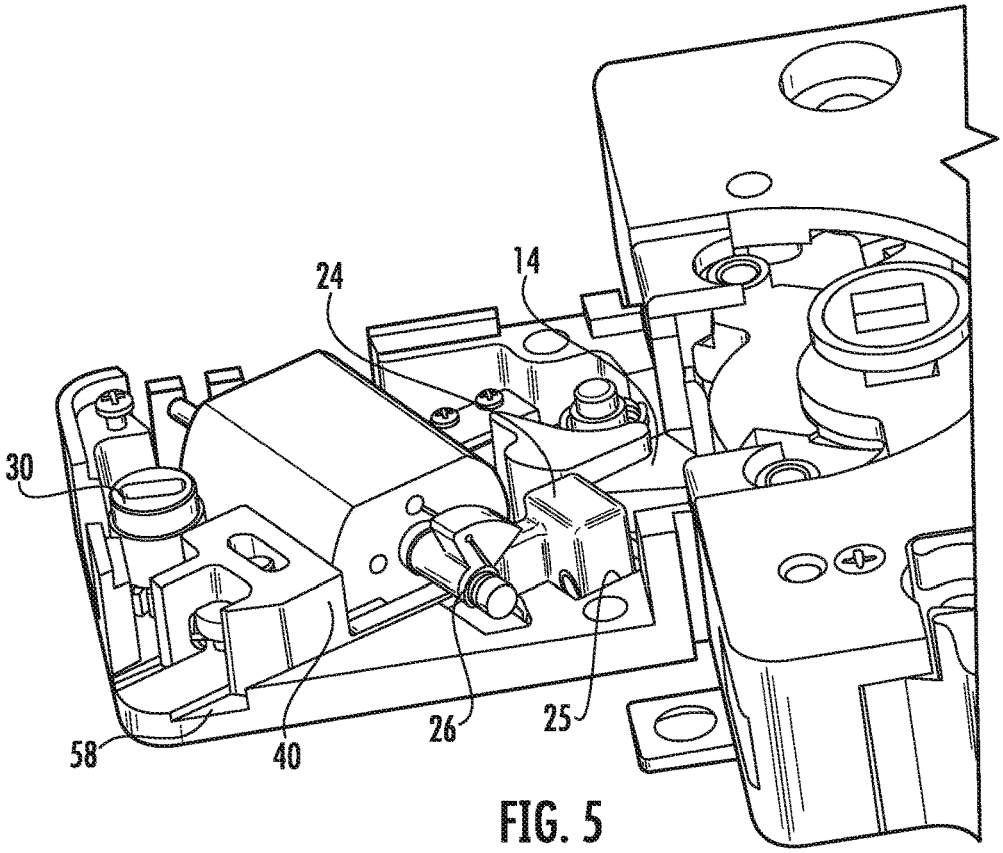
FIG. 5 illustrates the blocking module and extension, partially cut away, in manual override condition.
Figure 6A:
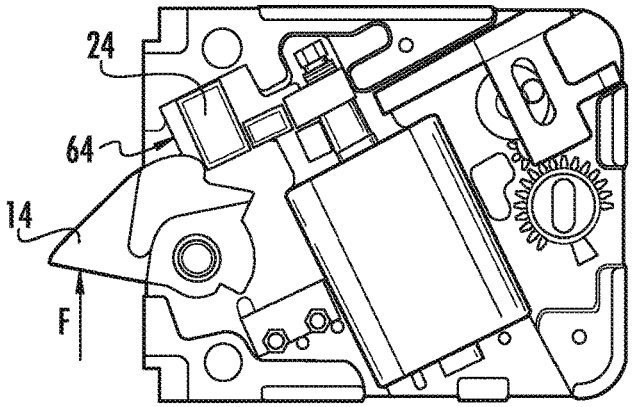
FIGS. 6A-6D illustrate component positions during retraction of the pivot bolt.
Figure 6B:
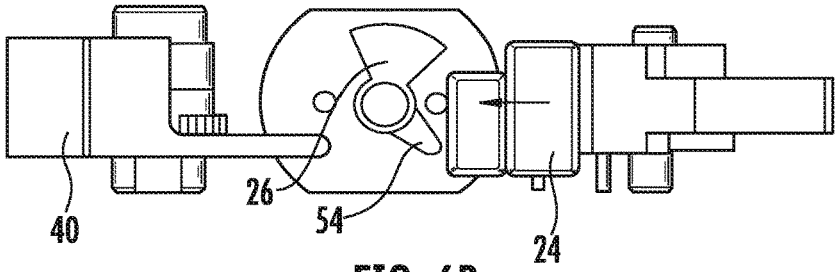
Figure 6C:
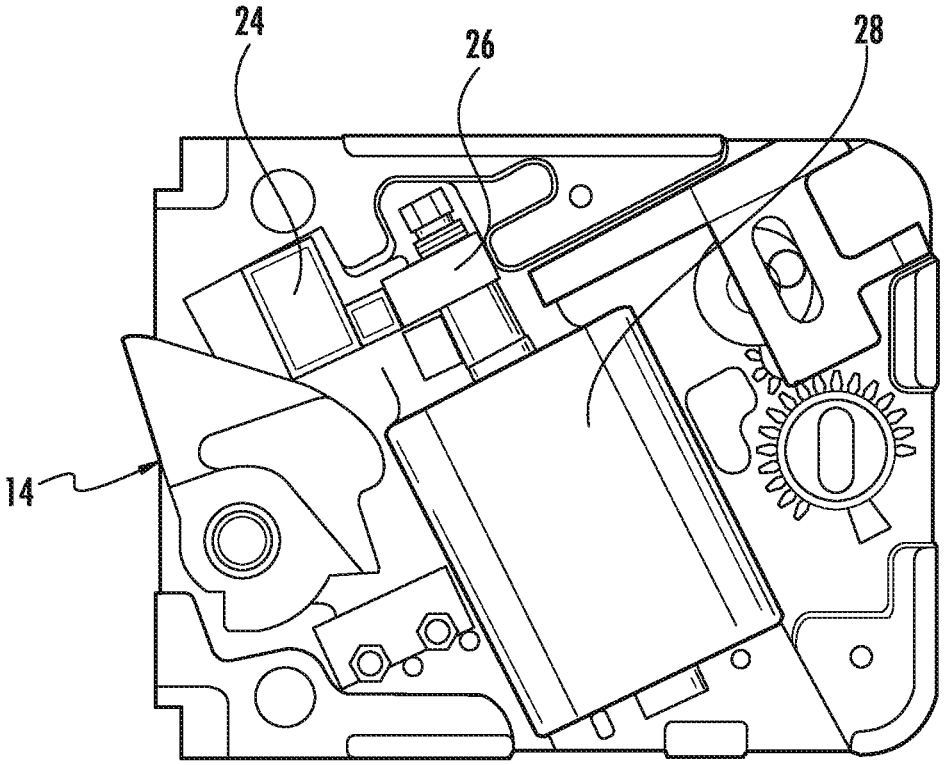
Figure 6D:
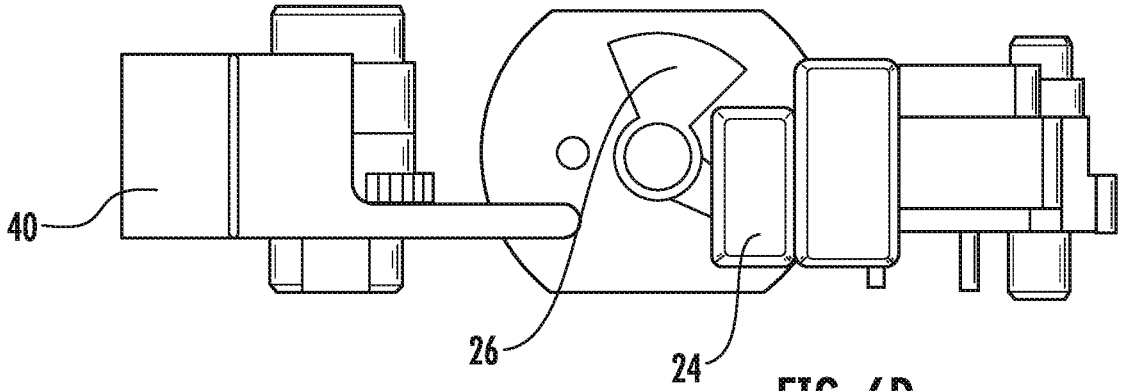

FIGS. 6A-6D illustrate the movement of the pivot bolt 14 and slide blocker 24 during retraction of pivot bolt 14 that results in the unsecured condition illustrated in FIG. 5. Initially, an electrical current has been applied to the motor 28 to rotate the spin blocker 26 counterclockwise to the position best seen in FIG. 6B. In FIG. 6A, an external force F is applied to the pivot bolt 14, urging it to rotate in a clockwise direction. As it rotates, it pushes the slide blocker 24 in the direction of arrow 64. The slide blocker 24 moves to the left, as seen in FIG. 6B, into the space previously occupied by the spin blocker 26. In FIG. 6C, the pivot bolt 14 is fully retracted and held by an external force and the sliding blocker 24 is prevented from returning to its nominal position. In FIG. 6D, the sliding blocker 24 is preventing the spin blocker 26 from returning to its nominal position.

Figure 7A:
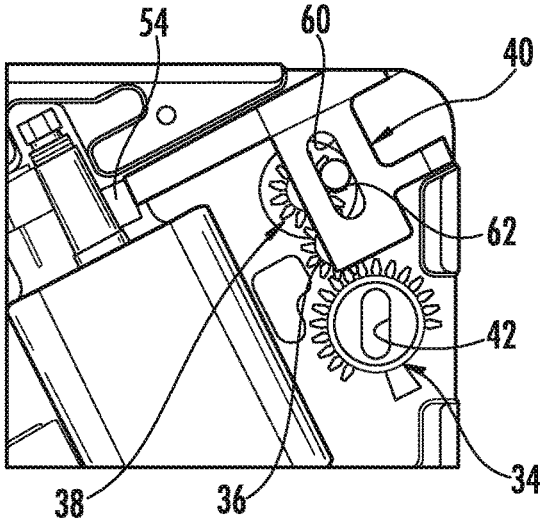
FIGS. 7A-7C illustrate the manual override.
Figure 7B:
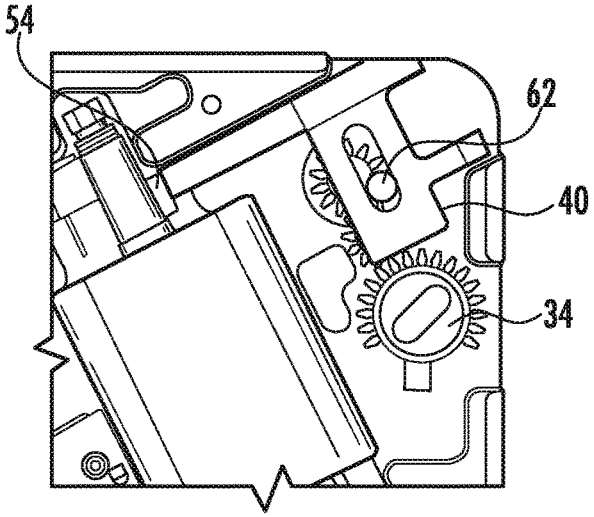
Figure 7C:
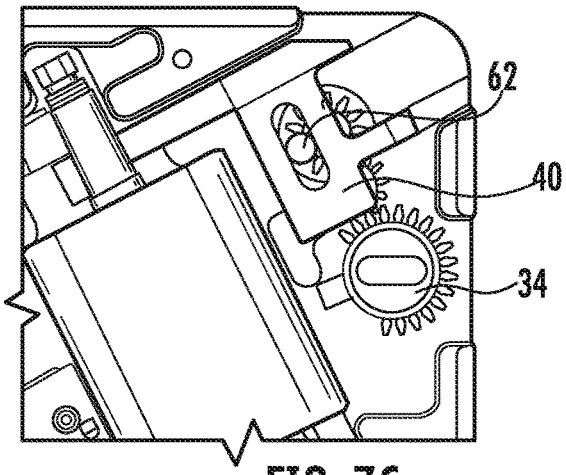

For keyed access control, illustrated in FIGS. 7A-7C, the user inserts a key into a lock cylinder (not shown) in the door and turns the key ~90° in either direction. A flat spindle extending from the back of the lock cylinder is disposed in the drive gear slot 42, thereby transferring the rotation of the user's key to rotation of the drive gear 34. The drive gear 34 transfers the rotary motion of the key, via the idler gear 36, to the drive pin gear 38. As noted above, the pin 62 on the drive pin gear 38 is disposed in the slot 60 formed in the plunger 40. As the drive pin 62 bears on the plunger slot 60, the plunger 40 translates toward the spin blocker 26, thereby pushing the lever 54 and lifting the spin blocker 26 out of the path of the sliding blocker 24. Thereafter, rotation of the pivot bolt 14 forces the slide blocker 24 into the space previously occupied by the spin blocker 26.

To secure the lock, the user must rotate the key back to home position were the key can be removed. All lock internal components will spring back to their respective nominal positions under the biasing forces of the torsion springs 44 and 48 and the compression spring 46. The plunger returns to its nominal position by the pin 62 acting on the slot 60 as the drive pin gear 38 rotates in response to the rotation of the key.

For either type of access control employed, movement of the pivot bolt is due to external forces applied by other components in the lock extension. Similarly, these same components must move back to their original position to allow the pivot bolt to rotate back to secured position. A micro switch within the lock assembly senses pivot bolt position and can provide this signal to the lock extension controls.

Advantageously, the present invention gives the lock two methods of access control and allows the end user to employ either or both in a given installation. In addition, the lock can be reversed to accommodate right or left handed door configurations. Key rotation in either direction results in the same necessary motion required for access. Further, packaging of lock internal components is efficient yet compatible with the industry standard high security lock foot print ("magic module") and smaller foot prints.

The above-described embodiment is not to be considered as limiting the breadth of the present invention. Modifications and other alternative constructions will be apparent that are within the spirit and scope of the invention as defined in the appended claims. For example, one variation might include the use of cams and levers in lieu of the gear train described above for the mechanical override.

The invention claimed is:

1. An electromechanical lock comprising:

a lock extension and a blocking module, the blocking module having an interior region;

a pivot bolt mounted in the interior region for rotation about a rotation axis between a nominal position and an unsecured position, wherein the pivot bolt is biased to its nominal position by a first torsion spring;

a first blocker disposed in the interior region for movement between a nominal position and an unblocking position, wherein the first blocker is biased to its nominal position by a compression spring;

a second blocker disposed in the interior region for movement between a nominal position and an unblocking position, wherein the second blocker is biased to its nominal position by a second torsion spring; and an override disposed in the interior region for movement between a nominal position and an override position, the lock being in a secured condition when the first and second blockers and the override are in their respective nominal positions and an unsecured condition when the second blocker is in its unblocking position.

2. The lock of claim 1, wherein the override includes a plunger configured to engage the second blocker to move the second blocker out of its nominal position when the override moves to its override position.

3. The lock of claim 1, wherein the override includes a drive mechanism configured to translate the rotation of a key in a lock cylinder into movement of the override from the nominal position to the override position.

4. The lock of claim 3, wherein a plunger includes a pin-receiving slot and a drive train includes a gear having a pin formed thereon and disposed in the pin-receiving slot, whereby rotation of the gear moves the pin to urge the plunger to the override position.

5. The lock of claim 1, wherein the second blocker is in the unblocking position and the lock is unsecured when the override is in the override position.

6. The lock of claim 1, wherein the first blocker moves linearly between its nominal and unblocking positions and the second blocker rotates between its nominal and unblocking positions.

7. The lock of claim 1, further comprising a motor configured for moving the second blocker.

8. An electromechanical lock comprising:

a lock extension and a blocking module, the blocking module having an interior region;

a pivot bolt mounted in the interior region for rotation about a rotation axis between a nominal position and an unsecured position, wherein the pivot bolt is biased to its nominal position by a first torsion spring;

a first blocker disposed in the interior region for linear movement between a nominal position and an unblocking position, wherein the first blocker is biased to its nominal position by a compression spring;

a second blocker disposed in the interior region for rotational movement from a nominal position blocking the first blocker to an unblocking position, wherein the second blocker is biased to its nominal position by a second torsion spring; and an override disposed in the interior region for movement between a nominal position and an override position, the lock being in an unsecured condition when the override is in the override position.

9. The lock of claim 8, wherein the second blocker is in the unblocking position when the override is in the override position.

10. The lock of claim 8, wherein the override includes a plunger having a pin-receiving slot and a drive mechanism having at least one gear, the plunger being movable between a nominal position and an override position, the at least one gear including a pin disposed in the pin-receiving slot, the plunger moving to the override position in response to rotation of the at least one gear.

11. The lock of claim 8, wherein the override includes a drive gear, an idler gear and a drive pin gear, the drive pin gear being configured to convert rotation of the drive gear into movement of the override between the nominal position and the override position.

12. The lock of claim 8, further comprising a motor configured to rotate the second blocker from its nominal position.

13. The lock of claim 8, wherein the first blocker blocks rotation of the pivot bolt in its nominal position and allows rotation of the pivot bolt to its unsecured position.

14. An electromechanical lock having a secured condition and an unsecured condition comprising:

a lock extension and a blocking module, the blocking module having an interior region;

a pivot bolt mounted in the interior region for rotation about a rotation axis between a nominal position and an unsecured position, wherein the pivot bolt is biased to its nominal position by a first torsion spring;

a first blocker disposed in the interior region for movement between a nominal position and an unblocking position, wherein the first blocker is biased to its nominal position by a compression spring;

a second blocker disposed in the interior region for movement between a nominal position and an unblocking position, the pivot bolt being prevented from moving to the unsecured position when the second blocker is in its nominal position, wherein the second blocker is biased to its nominal position by a second torsion spring; and a manual override disposed in the interior region positioned to drive a plunger, wherein the plunger translates linearly between a nominal position and an override position.

15. The lock of claim 14, wherein the lock is in a secured condition when the first and second blockers are in their respective nominal positions and unsecured when the first and second blockers are in their respective unblocking positions.

16. The lock of claim 14, wherein the plunger is positioned to move the second blocker to its unblocking position.

17. An electromechanical lock comprising:

a lock extension and a blocking module, the blocking module having an interior region;

a pivot bolt mounted in the interior region for rotation about a rotation axis between a nominal position and an unsecured position, wherein the pivot bolt is biased to its nominal position by a first torsion spring;

a first blocker disposed in the interior region for movement between a nominal position in which the pivot bolt is prevented from moving out of its nominal position and an unblocking position in which the pivot bolt is permitted to move from its nominal position, wherein the first blocker is biased to its nominal position by a compression spring;

a second blocker disposed in the interior region for movement between a nominal position in which the pivot bolt is prevented from moving out of its nominal position and an unblocking position in which the pivot bolt is permitted to move from its nominal position, wherein the second blocker is biased to its nominal position by a second torsion spring; and an override movable between a nominal position and an override position, the override being configured to allow the pivot bolt to move from its nominal position when the override is in the override position.

18. The lock of claim 17, wherein the second blocker moves to its unblocking position in response to movement of the override to the override position.

19. The lock of claim 17, wherein the override includes a plunger and a drive mechanism, the plunger moving linearly between a nominal position and an override position in response to movement of the drive mechanism.

* * * * *